United States Patent [19]

Klaus et al.

[11] 4,206,687

[45] Jun. 10, 1980

[54] CUSHIONING DEVICE FOR A PISTON OF A PNEUMATICALLY OPERABLE DRIVING TOOL

[75] Inventors: Arthur Klaus, Bad Homburg von der Hohe; Horst Tacke, Bad Vilbel, both of Fed. Rep. of Germany

[73] Assignee: Signode Corporation, Glenview, Ill.

[21] Appl. No.: 913,492

[22] Filed: Jun. 7, 1978

Related U.S. Application Data

[63] Continuation of Ser. No. 649,242, Jan. 15, 1976, abandoned.

[30] Foreign Application Priority Data

Jan. 31, 1975 [DE] Fed. Rep. of Germany ..... 2504094

[51] Int. Cl.[2] ..... F15B 15/22

[52] U.S. Cl. ..... 91/395; 91/407; 91/410; 92/85 R; 92/85 B; 227/130

[58] Field of Search ..... 92/85 R, 85 A, 85 B, 92/9, 65, 80, 143; 91/405, 50, 303, 404, 410, 25, 395, 407; 227/130

[56] References Cited

U.S. PATENT DOCUMENTS

| | | | |
|---|---|---|---|
| 3,273,469 | 9/1966 | Doyle | 92/85 R |
| 3,434,643 | 3/1969 | Wandel | 227/130 |
| 3,479,926 | 11/1969 | Hillier | 91/404 |
| 3,608,437 | 9/1971 | Little | 92/85 B |
| 3,905,278 | 9/1975 | Ourdouillie | 92/85 A |

*Primary Examiner*—Abraham Hershkovitz

*Attorney, Agent, or Firm*—Dressler, Goldsmith, Shore, Sutker & Milnamow, Ltd.

[57] ABSTRACT

The invention relates to a cushioning device for a piston of a pneumatically operable driving tool which includes a cylinder, wherein a drive piston connected to a driver blade is axially movable; including further a bumper at the lower end of the cylinder and an annular chamber connected to a fluid power reservoir; this chamber is located underneath the piston and is surrounding the driver blade. The annular chamber, created by the piston and a wall, generally parallel to the face of the piston, will be reduced in volume to a certain extent when the wall impacts on the bumper to reduce the noise generated during the driving action.

4 Claims, 6 Drawing Figures

2a
2
1
2b
3
12
5
6
4
11
7
8
10
9

102
100
102b
104
111
105
103
101
106
107
112
110

202
207
202b
200
204
212
211
201
213
210

302
300
307
304
321
315
311
305
313
312
319
318
323
322
320
301
303
314
310
317
316

307
300
302
311
316
305
319
320
322
304
323
310
317
312

402
407
400
404
418
416
424
415,426
425
411
405
413
419
412
420
427
414
422
401
403

CUSHIONING DEVICE FOR A PISTON OF A PNEUMATICALLY OPERABLE DRIVING TOOL

This is a continuation of application Ser. No. 649,242, filed Jan. 15, 1976, now abandoned.

Recent regulations in the occupational safety area resulted in a greater need to reduce the noise emission of these pneumatically operable driving tools.

The great majority of today's pneumatically operable driving tools exceed the peak noise level limit considered damaging to the hearing ability by occupational enforcement agencies by up to 10 dba, in particular in the frequencies of 2000–8000 Hz which are most destructive to the hearing ability. As a result, there is a need for a noise reduction of these driving tools such that peak noise levels will either be reduced or shifted into a frequency area which is not as dangerous.

The emitted noise of pneumatic nailing and stapling tools is generally an impulse noise occurring during every working cycle, when the drive piston impacts on the bumper. It is well known that the power of pneumatic nailing tools will be derived from the kinetic energy of the quickly accelerated drive piston. This energy, however, will be only used up to a small extent by driving the fastener. The remaining energy has to be absorbed by the bumper located at the lower end of the cylinder. This bumper has to bring the piston to a complete stop, while deflecting as a rule approximately 1 mm. At the moment when the piston hits the bumper, a high peak noise level is created, whose level will depend on piston velocity or the air pressure powering the tool, the length and the thickness of the fastener elements which determines the energy absorbed by the fastener element and further depending on the bumper hardness reflected by the stopping distance necessary to reduce the piston speed to zero. When the piston impacts on a soft bumper, resulting in a longer stopping distance, the noise is substantially lower. An application of bumpers, however, with a lower hardness than 80 shore is not possible because its life will be reduced to an uneconomical level. Of course, a longer stopping distance and a better result also could be achieved by using a thicker bumper out of a hard material. This alternative, however, would increase the overall height of the hand tool negatively.

Therefore, the problem is to design a cushioning device which will result in a softer impact of the piston and, consequently, achieve a reduced noise emission without negatively influencing the height of the life of the tool.

The object of the present invention is to reduce the peak noise level in a tool with a low weight piston, whenever the piston impacts on the bumper.

In accordance with the instant invention, the noise generated during the driving action of the tool is substantially minimized by providing an air cushion below the driving piston. The impact of the piston on the air cushion results in the transfer of compressed air back into the main reservoir of the tool, with the result that there is a lower deceleration of the driving piston and a consequent reduction of impact noise.

The invention can be applied to driving tool pistons with a differential diameter return system as well as pistons with an air chamber return system. In the first case, the annular chamber below the drive piston is directly connected to the air reservoir of the tool while in the latter case the chamber is connected to the reservoir via the piston air return chamber.

The invention will be explained in more detail in some drawings of some preferred embodiments, in which.

Figure 1:
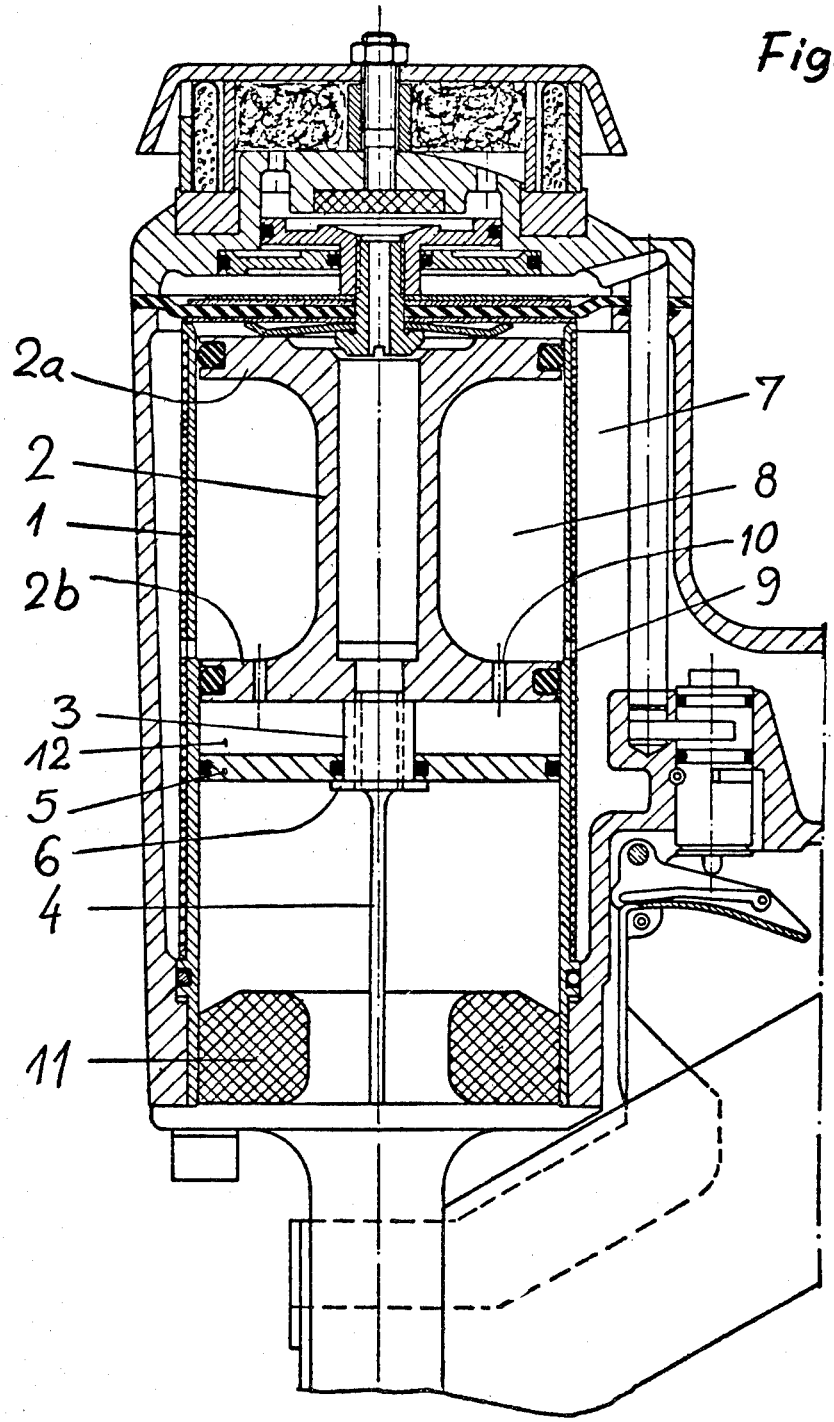
FIG. 1 is a sectional view of a first embodiment of the invention.

FIG. 1 shows a sectional view of a pneumatically operable driving tool with a stepped cylinder 1 axially guiding a differential diameter piston 2. Its upper flange **2*a* has a larger diameter than its lower flange 2*b*. Connected to piston 2 is a driver blade 4 extending downwardly to drive a fastener (not shown) e.g., a nail into a workpiece. At the upper end of driver 4, a cylindrical portion 3 is provided axially guiding a disc 5, preferably made out of an impact-resistant plastic. Cylindrical portion 3 of driver 4 is provided with a shoulder 6 serving as a stop for disc 5. Cylinder wall 1 is provided with ports 9 connecting the interior of the cylinder with the air reservoir 7. If the driving tool will be connected to compressed air (not shown), reservoir 7 and annulus 8 between piston flanges 2*a* and 2*b* will be pressurized. Ports 10 are drilled into lower piston flange 2*b* allowing air to pass into the annular chamber 12 defined by the lower piston flange 2*b* and disc 5. The pressure will seat disc 5 against shoulder 6. When the trigger-operated valve is opened, the diaphragm valve closing off cylinder 1 is moved upwardly and air pressure suddenly will be applied to the upper face of piston flange 2*a* such that piston 2 in unison with driver 4** will be forced downwardly into its power stroke. For more detailed information regarding the operation of a tool of this type see U.S. Pat. No. 3,815,475.

At a certain distance from the lowermost point of piston 2 during the driving action disc 5 will engage bumper 11 which is supported on a bottom plate of cylinder 1. As a result, disc 5 will be lifted from shoulder 6 and moved towards the lower piston flange **2*b*. The air in annular chamber 12 will be partially displaced into the upper annulus 8 and the air reservoir 7 via ports 9 in cylinder wall 1. The result is a softer stopping of piston 2**, which leads to a reduction in impact noise.

Figure 2:
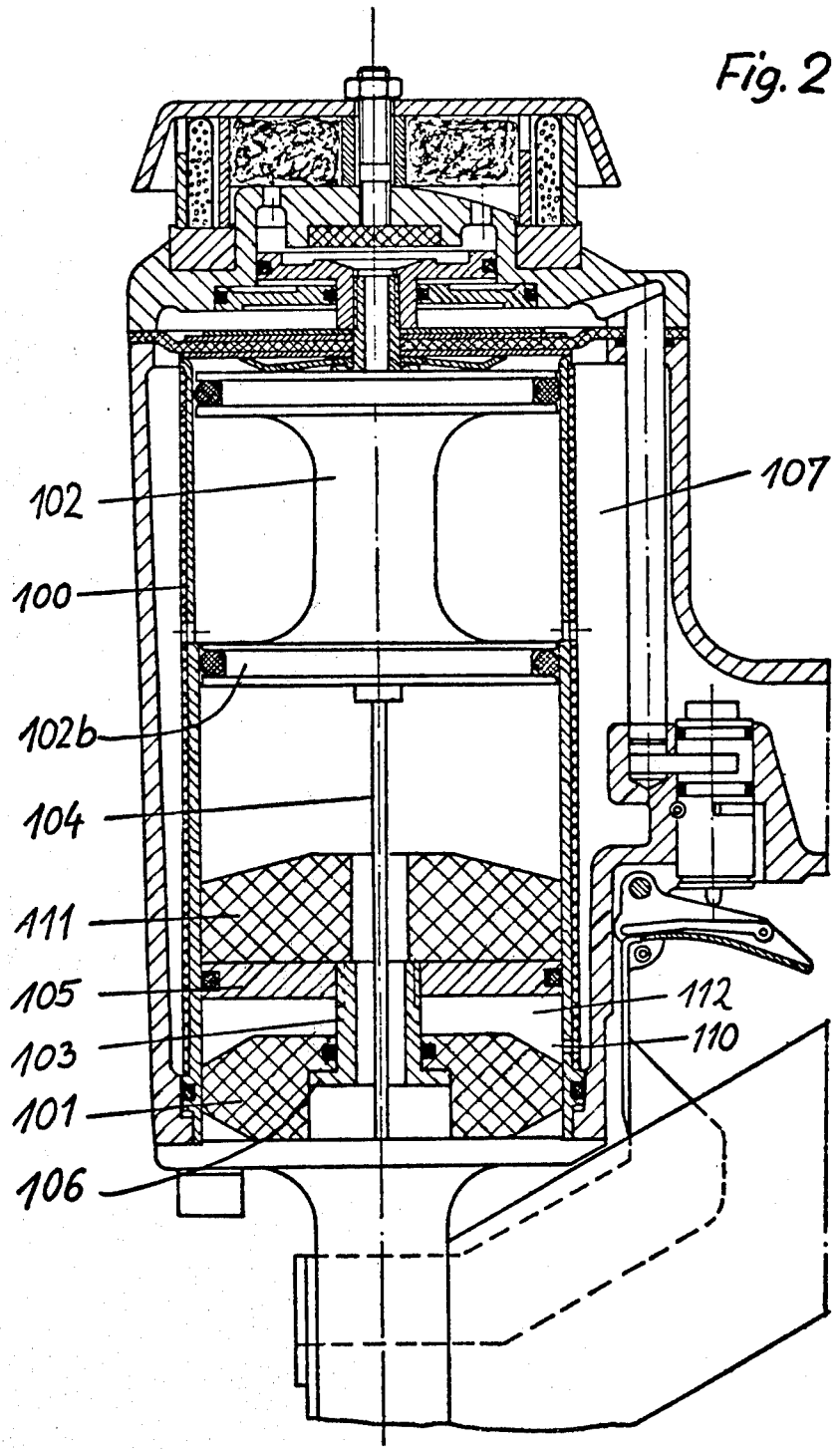
FIG. 2 is a sectional view of a second embodiment of the invention.

In the embodiment of the cushioning device according to the invention shown in FIG. 2, the annular chamber 112 with variable volume is located between the bottom flange 101 of the cylinder, cylinder wall 100 and disc 105. Disc 105 is provided with a cylindrical portion 103 surrounding driver blade 104. Said portion is axially movable in a bore of bottom plate 101 and provided with a shoulder 106 limiting movement of said portion. In this embodiment, bumper 111 is supported by disc 105. When piston 102 engages bumper 111 with its lower piston flange **102*b* near the lowermost point, bumper 111 and disc 105 will be moved together towards bottom plate 101 of the cylinder. The air in annular chamber 112 which is defined by disc 105, bottom plate 101 and cylinder wall 100 will be partially returned to air reservoir 107, whereby a pneumatic cushioning of the drive piston 102** will take place, the effect of which will vary with the operating air pressure.

Figure 3:
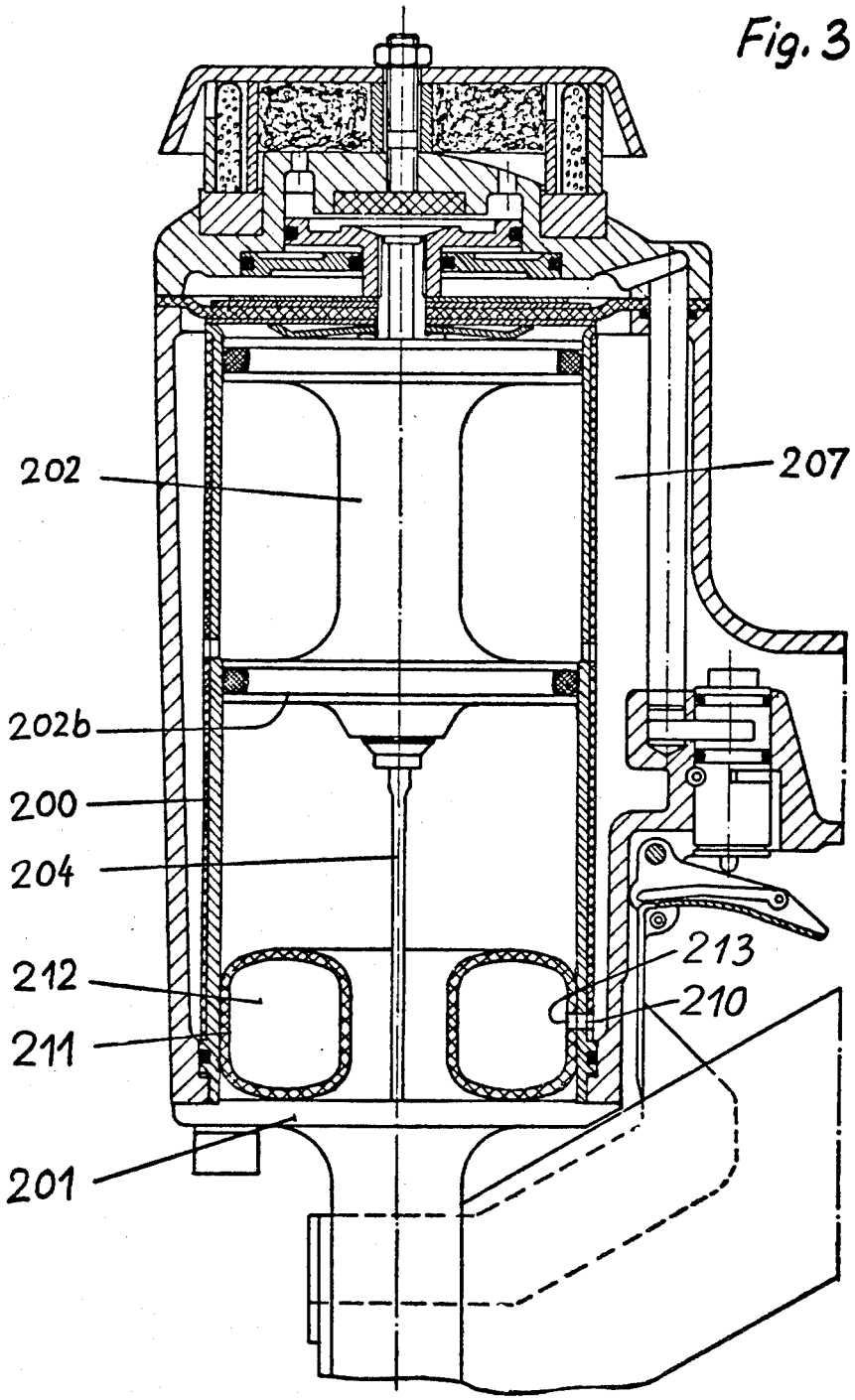
FIG. 3 is a sectional view of a third embodiment of the invention.

The embodiment of the cushioning device according to the invention shown in FIG. 3 shows an annular chamber 212 with variable volume formed by bumper 211. To serve in this function, bumper 211 is designed as a hollow ring and made out of an elastic material surrounding driver blade 204 and supported by bottom plate 201. The outer wall of bumper 211 is provided with a port 213 communicating with a port 210 in cylinder wall 200. When piston 202 near its lowermost point impacts bumper 211 with its flange **202*b*, the bumper will be compressed to a lower volume against bottom plate 201 of the cylinder. The compressed air in annular chamber 212 created by bumper 211 will pass through port 213 in bumper 211 and through opening 210 in cylinder wall 200 back into air reservoir 207**.

As explained above, this cushioning device according to the invention reveals a pneumatic cushioning or deceleration means for the drive piston which is dependent on the operating pressure, whereby the peak noise level can be reduced substantially when the drive piston impacts the bumper. The embodiments shown in FIGS. 1 to 3 have been explained utilizing a cushioning device designed with a differential diameter piston. The invention, however, can also be applied advantageously to driving tools using a disc piston with an air return chamber.

Embodiments of the invention shown in FIGS. 4 and 5 will be explained utilizing a pneumatically operable driving tool in which the drive piston 302, designed as a disc piston, is reciprocating inside cylinder 300.

Arranged at the bottom end of cylinder 300 is bumper 311 supported by disc 305, which is provided with a cylindrical portion 303 and which in turn is axially guided in the cylindrical portion 314 of bottom plate 301 of cylinder 300. Therefore, disc 305 in combination with cylinder wall 300 and bottom plate 301 of the cylinder create an annular chamber 312 with variable volume. This annular chamber 312 communicates with air reservoir 307 of this driving tool by means of port 313 arranged in cylinder wall 300. Upward movement of disc 305 is limited by the annular stop 315 in cylinder wall 300. Below this annular stop 315 in cylinder wall 300 wide cutouts 316 are provided. Additional ports 310 are located at the lower end of cylinder wall 300 serving in a check valve function. Into the center port 318 of disc 305 an O-ring has been inserted, whose inside diameter is smaller than the outside diameter of stem 320 which is part of the bottom plate 301 guiding driver blade 304. When air pressure from air reservoir 307 will be applied to the upper side of piston 302 by opening the trigger-operated control valve, piston 302 will be driven downwardly in its power stroke, while the air under atmospheric pressure in cylinder 300 will be purged via ports 321, 318 of bumper 311 and disc 305 respectively and via opening 322 in bottom plate 301.

When piston 302 at the end of power stroke impacts on bumper 311, it will continue to move in unison with disc 305 compressing the air in annular chamber 312 until the air escapes via check valve 317 into air reservoir 307. While disc 305 is moving downwardly, the wide cutout sections 316 in cylinder wall 300 will be opened (see FIG. 5), so that compressed air from reservoir 307 will enter directly underneath piston 302 and stop it.

Simultaneously, the annular seal 319 located in center opening 318 of disc 305 will engage stem 320 so that compressed air entering into the cylinder through cutouts 316 will not escape via ports 327.

After closing the trigger-operated control valve, compressed air in cylinder 300 above piston 302 will be vented to atmosphere. Thus, piston 302 will be forced upward by compressed air entering cylinder 300 via cutouts 316.

Driver blade 304 is provided with a relief 323 which will be positioned in the area of stem 320 when piston 302 is in its upward position. When piston 302 has returned to its initial position (see FIG. 4), an opening will be created in stem 320, permitting air under piston 302 to escape to atmosphere. In turn, pressure on the upper side of disc 305 eventually will be lower than the opposite side, because annular chamber 312 will be in constant communication with air reservoir 307 via ports 313.

This differential pressure on disc 305 will move it upwardly into its initial position until reaching annular stop 315 inside cylinder 300. During this movement, annular seal 319 of disc 305 will disengage stem 320, while cutouts 316 in cylinder wall 300 will be closed by disc 305. This will restore the initial condition as shown in FIG. 4 and the driving tool will be ready for a new working cycle.

The particular advantage of this embodiment is that movement of piston 302 will not only be stopped by bumper 311 and the air cushion in annular chamber 312 but in addition by compressed air entering through the cutouts 316 to return the piston.

Figure 4:
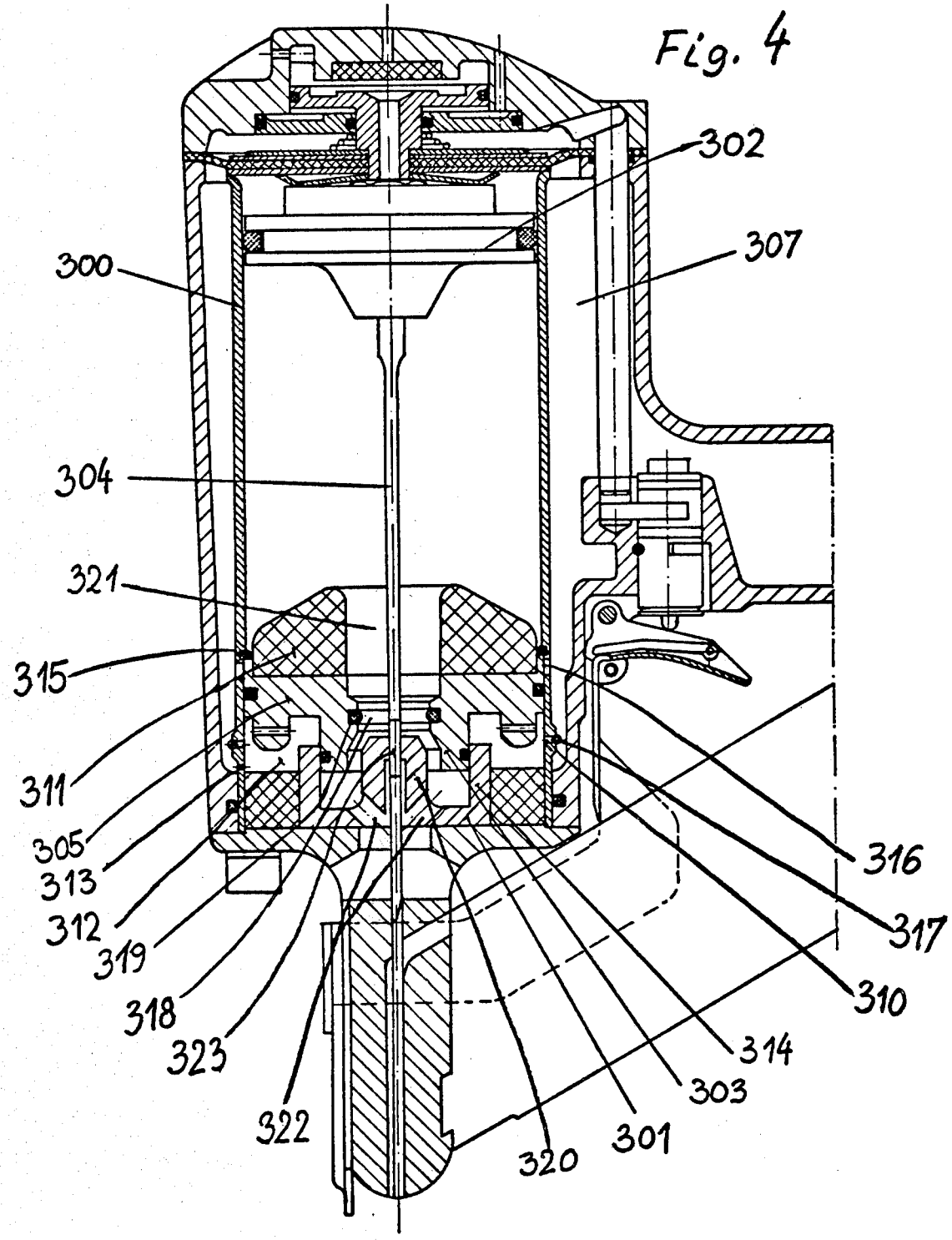
FIG. 4 is a sectional view of a fourth embodiment of the invention.
Figure 5:
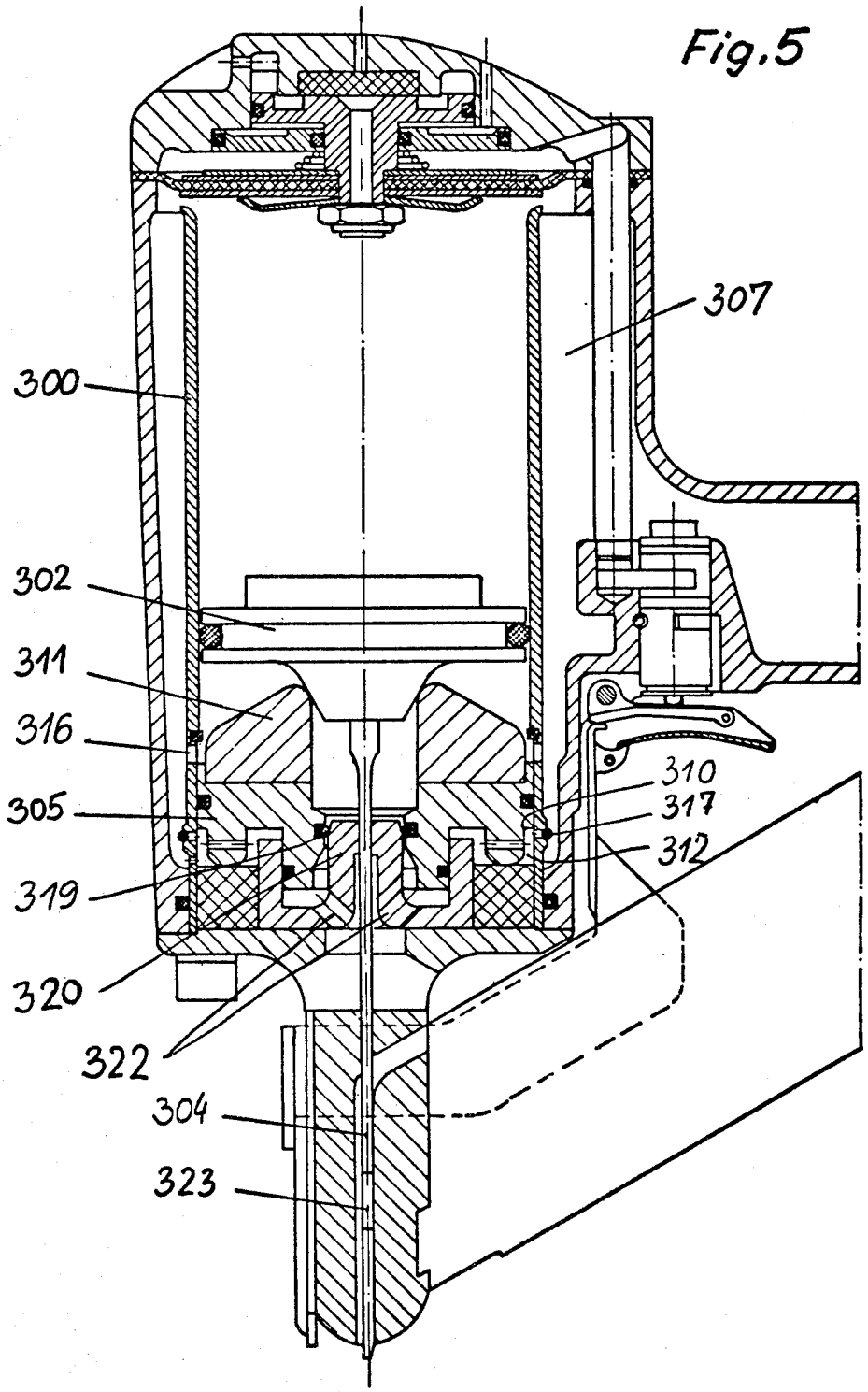
FIG. 5 is a sectional view according to FIG. 4 with the drive piston in lowermost position.

As shown in the embodiments of FIGS. 4 and 5, the disc will be returned to its initial position by applying higher pressure on its bottom side than its top side. However, the required force differential can also be achieved by enlarging the bottom area of the disc subjected to returning air. This idea is shown in the modified embodiment shown in FIG. 6.

Figure 6:
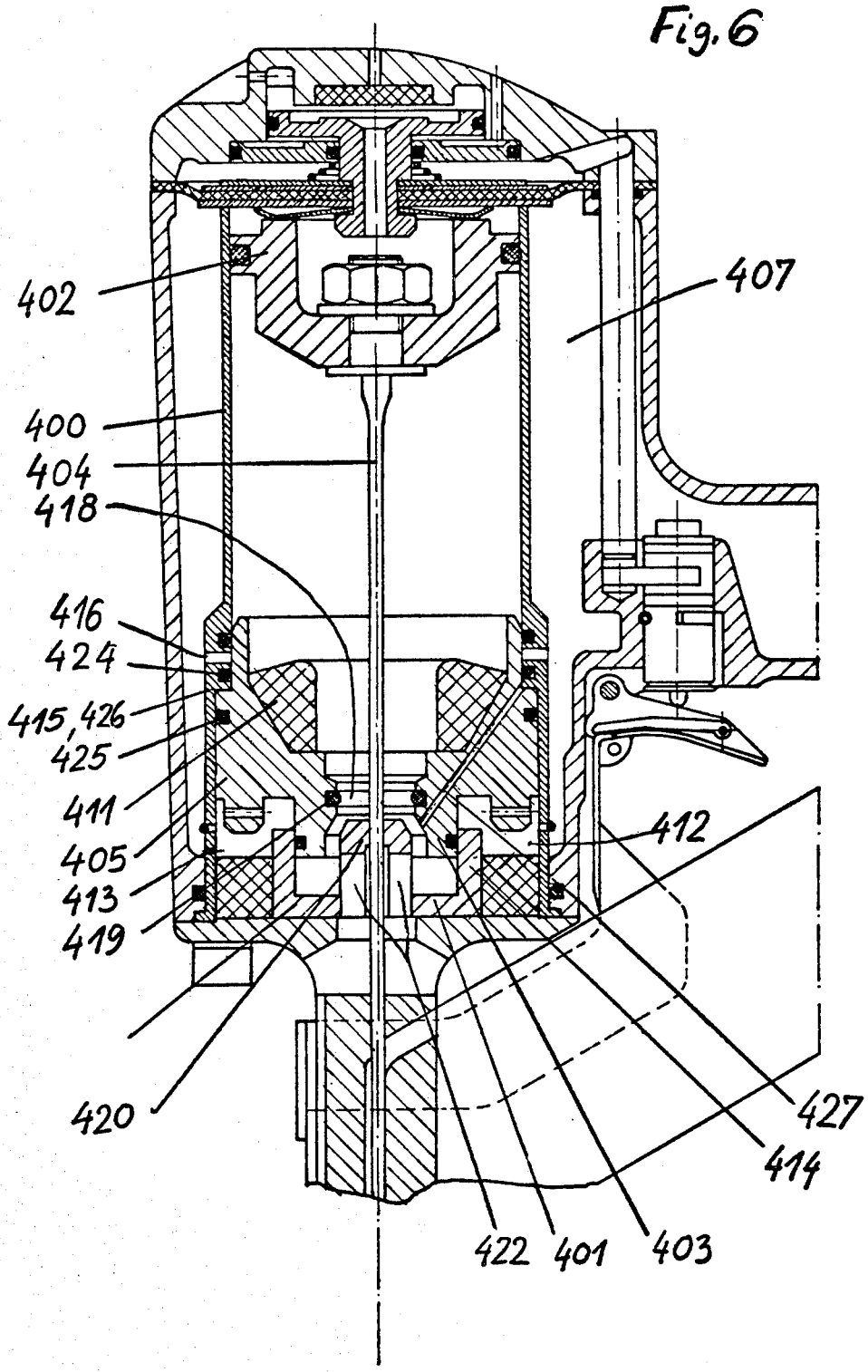
FIG. 6 is a sectional view of a fifth embodiment of the invention.

The embodiment of the invention shown in FIG. 6 is different from those shown in FIGS. 4 and 5, because the relief in the driver blade is not required anymore, since the upward force applied to the disc is always larger than the downward force.

This will be accomplished by recess 415 of cylinder 400 serving also as stop for the upward movement of disc 405 designed with a matching recess 426. Above recess 415 the cylinder wall 400 is provided with cutouts 416 which are sealed off when disc 405 is in the upper position and which are opened after piston 402 displaces disc and bumper 411 downwardly. The functions of these cutouts 416 are, therefore, the same as those shown in FIGS. 4 and 5.

In the area of the cutouts 416 and recess 415, one O-ring 424 is located in cylinder wall 400. Another O-ring 425 is arranged below the recess on disc 405. The annulus created between recess 415, 426, cylinder 400, and disc 405 is constantly vented to atmosphere by virtue of port 426 in disc 405.

When disc 405 is located in its lower position (compare FIG. 5), its upper and lower side are exposed to the same pressure, because cutouts 416 connect the interior of cylinder 400 with air reservoir 407 while prot 413 connects it to annular chamber 412.

As can be seen in FIG. 6, pressure will be applied to the lower side of disc 405 in an annular area whose outside diameter corresponds to the inside diameter of recess 415 in cylinder 400 and whose inside diameter corresponds to the outside diameter of stem 403. On the other hand, pressure will be applied to the upper side of disc 405 in an annular area whose outside diameter corresponds to the inside diameter of cylinder 400 and whose inside diameter corresponds to the inside diameter of center opening 418 and annular seal 419.

By appropriately sizing the above diameters, the area below disc 405 will be larger than its upper side. This results in a net upward force on disc 405 powerful enough to return lowered disc 405 to its initial position.

The increased deceleration of piston 402 is the result of a larger exposed area on the lower side of disc 405.

It is, of course, intended to cover by the following claims all such modifications and improvements that fall within the scope thereof.

What is claimed is:

1. A cushioning means for the impact piston assembly movable between a driving and driven position of a pneumatically operable driving tool disposed within a cylinder and having a driver blade assembly connected thereto, comprising first means defining an annular chamber including an apertured bottom plate assembly closing off the end of the cylinder through which the driver blade assembly extends surrounding said driver blade assembly and including port means positioned to be connected to a pressure medium storage chamber for cushioning the force of said piston assembly, said first means including a bumper located at the bottom of the cylinder and an axially displaceable boundary wall in sealing and sliding engagement with said cylinder and the driver blade assembly and disposed substantially parallel to said piston, the boundary wall being axially moved by said piston assembly prior to final impact of the piston assembly and having located thereabove an annular bumper positioned to be engaged by the piston assembly during the driving action, said boundary wall also having a central bore defining a seat surrounding the driver blade assembly and an annular section closing off ports defined in the cylinder wall positioned to be connected to the pressure medium storage chamber and the bottom plate assembly having a central boss portion designed to close off said bore upon engagement with said seat, and means for venting the space below the piston assembly after it has been returned to its driving position, the boundary wall being moved by the piston assembly upon engagement of the piston assembly with said bumper to reduce the volume of the annular chamber to cushion the impact of the piston assembly and reduce the impact noise, the central bore in the boundary wall being closed off, the ports in the cylinder wall being opened to permit the piston assembly to be returned to its driving position and thereafter the chamber below the piston assembly being vented to condition the piston assembly for a subsequent driving action.

2. A cushioning means as set forth in claim 1 in which the bottom plate assembly includes a generally cylindrical member that defines in its central region said central boss portion, said bumper located at the bottom of the cylinder being located between said cylindrical member and said cylinder.

3. A cushioning means as set forth in claim 2 in which said piston assembly and cylindrical member define cooperating sealing means for preventing leakage therebetween.

4. A cushioning means as set forth in claim 1 in which the port means includes a first port allowing constant flow communication between the annular chamber and storage chamber and a second port defined by said cylinder surrounding said annular chamber and check valve means closing said second port but permitting relief from said annular chamber during said cushioning action.

* * * * *